US005215070A

United States Patent [19]

Brown

[11] Patent Number: 5,215,070

[45] Date of Patent: Jun. 1, 1993

[54] ARROW HOLDER

[76] Inventor: Frank C. Brown, 1967 Genoa Ave., Akron, Ohio 44305

[21] Appl. No.: 703,154

[22] Filed: May 20, 1991

[51] Int. Cl.[5] ..... F41B 5/14; F41B 5/06

[52] U.S. Cl. ..... 124/86; 124/25.7; 124/45

[58] Field of Search ..... 124/25.5, 25.7, 41.1, 124/44.5, 45, 86, 88; 224/916

[56] References Cited

U.S. PATENT DOCUMENTS

| | | | |
|---|---|---|---|
| 2,464,068 | 3/1949 | Bear | 224/5 |
| 2,908,432 | 10/1959 | Kent | 224/5 |
| 2,909,167 | 10/1959 | Fredrickson | 124/45 X |
| 2,938,514 | 5/1960 | Berg | 124/25.7 X |
| 2,986,187 | 5/1961 | Gazzara | 224/916 X |
| 3,114,485 | 12/1963 | Whiffen | 124/45 X |
| 3,116,730 | 1/1964 | Tingley | 224/916 X |
| 3,337,099 | 8/1967 | Rose | 224/916 X |
| 3,595,214 | 7/1971 | O'Malley et al. | 124/25.7 |
| 3,716,174 | 2/1973 | Ehlert | 124/25.7 X |

OTHER PUBLICATIONS

"Knipp Hip Quiver", Archery Magazine, Jul. 1954, p. 38.

*Primary Examiner*—Andrew V. Kundrat
*Assistant Examiner*—John A. Ricci
*Attorney, Agent, or Firm*—Oldham, Oldham & Wilson Co.

[57] ABSTRACT

A device for conveniently securing a plurality of arrows to one another for ease of transport or, alternatively, for securing additional arrows to an existing quiver. The device comprises a wafer member made of a semi-rigid but resilient material, having notches formed in the corners for engaging the shaft portion of an archer's arrow. Such devices being preferably used with one or more like devices.

20 Claims, 4 Drawing Sheets

ARROW HOLDER

TECHNICAL FIELD

The present invention relates generally, to archery equipment and, more specifically, to a holder for arrows used alone or in conjunction with an arrow quiver.

BACKGROUND OF THE INVENTION

Bows and arrows are used in the sport of archery, for target practice and/or hunting. An archer commonly carries a supply of arrows in a quiver. Quivers of many varieties are known. Certain quivers are designed to be carried by the archer separately from the bow, while others are designed for attachment directly to the bow. Quivers of the latter type are generally attached in a manner parallel and along one side of the bow frame such that they do not interfere with shooting by the archer.

U.S. Pat. No. 2,464,068 to Bear discloses a quiver securely attached to an archery bow by means of a metal bracket for the removable attachment of arrows. The shaft of each arrow is snappingly inserted into one of a plurality of notches formed in the resilient rack. An elongated base extends below the bracket/rack combination to encase the arrow tips.

U.S. Pat. No. 2,908,432 to Kent again discloses a quiver for arrows and is designed to be carried on a waist belt or attached to the hip pocket of the archer. A body portion of the quiver comprises a pouch for encasing the arrow tips and frame connected to a means for carrying the quiver. A second bracket is attached to the upper portion of the frame and comprises a plurality of notches to receive corresponding arrow shafts.

U.S. Pat. No. 3,116,730 to Tingley discloses a quiver comprising an essentially vertical spindle attached to a bow by a pair of brackets. At each end of the spindle, and attached to each bracket, is a rotatable disc made of resilient material having a plurality of spaced notches around the outer circumference. Each notch is adapted to receive the shaft of an arrow. The quiver is capable of rotating attached arrows about the spindle. Additional clips are attached directly to the bracket portion of the quiver for the mounting of an additional arrow.

In U.S. Pat. No. 3,337,099, still another quiver design for attachment to an archer's belt is shown. This quiver utilizes a pair of essentially circular disc members with notches about their periphery adapted to receive an arrow shaft.

U.S. Pat. No. 3,114,485 to Whiffen discloses still another bow quiver attached directly to the archer's bow. The quiver comprises a pair of irregular shape support members. Each support member has an arrow support leg and a bow support leg. The bow support legs contain an aperture which is dimensioned to slidably engage the tapered length of a bow and engage the wider portion of the bow with a friction fit. The arrow support leg contains a plurality of notches adapted to receive the shaft of a corresponding arrow.

SUMMARY OF THE INVENTION

The present invention provides a device for conveniently securing a plurality of arrows to one another for ease of transport or, alternatively, for securing additional arrows to an existing quiver. The device comprises a wafer member made of a semi-rigid but resilient material, having notches formed in the corners for engaging the shaft portion of an archer's arrow. The wafer members are preferably used in pairs. Other embodiments of the present invention contemplate notches adapted to receive arrow shafts of varying diameters, a container or receptacle for housing additional arrowheads, and a means of storing a length of line on a wafer member.

It is, therefore, an object of the present invention to provide a device for attaching and retaining a plurality of arrows to one another.

It is a further object of the present invention to provide a device which permits the attachment of additional arrows to an archer's quiver.

It is still a further object to provide a device for further securing the arrows contained within an existing quiver.

It is a further object of the present invention to provide a device for holding arrows which is compact, lightweight, simple to use and easy for the archer to store following use.

It is still a further object of the present invention to provide an arrow holder which is effective yet inexpensive to manufacture.

It is yet a further object of the present invention to provide an arrow holder which is capable of engaging arrow shafts of varying diameter.

It is still a further object of the present invention to provide an arrow holder which is capable of receiving advertising information or printed indicia thereon.

It is also an object of the present invention to provide an arrow holder which is capable of storing a length of line and/or additional arrowheads for the archer.

These and other objects and advantages will become more readily apparent from the more detailed discussion of the preferred embodiment, taken in conjunction with the drawings wherein similar elements are identified by like numerals through several views. Such objects and advantages are achieved by an arrow holder comprising: at least one essentially flat, resilient retaining body having a sufficient thickness to contribute support to said member and a periphery defining at least one outer wall, said periphery having a plurality of notches formed therein, each notch connected to said outer wall by an opening sufficient to allow passage of an arrow shaft therethrough, each notch dimensioned to receive said arrow shaft with a friction fit.

DETAILED DESCRIPTION OF THE PREFERRED EMBODIMENT

Figure 1:
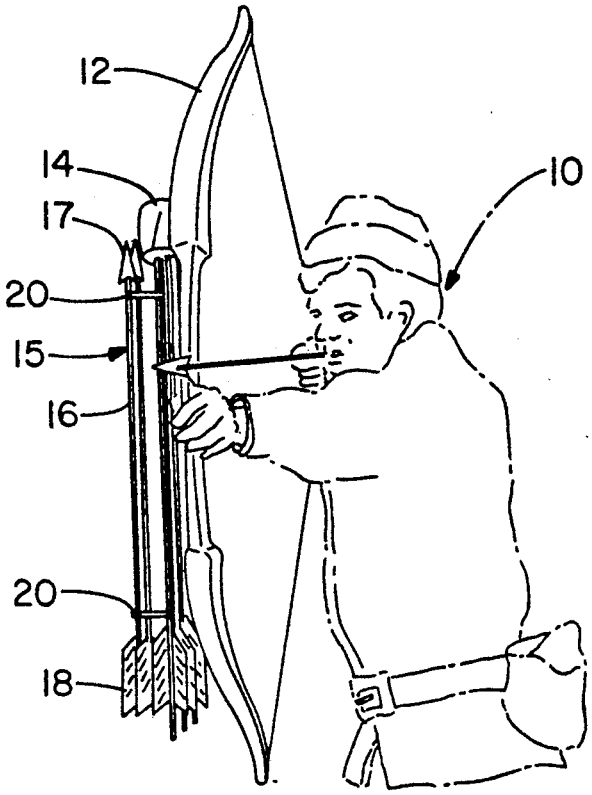
FIG. 1 is a perspective view of the present invention functioning to secure additional arrows to the archer's quiver.

Now, this invention will be described in detail with reference to the preferred embodiments thereof. FIG. 1 discloses an archer 10 with a raised and drawn bow 12 to which a quiver 14 is attached to the bow frame. Quiver 14 holds a supply of arrows 15 in a position parallel to and on one side of the bow frame 12 so as not to obstruct the archer's aim.

Figure 2:
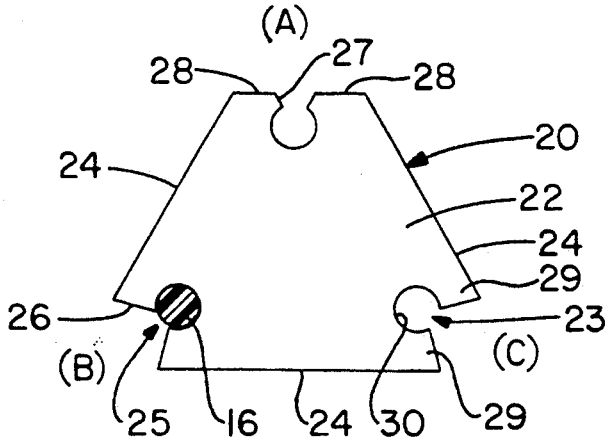
FIG. 2 is a top elevational view of a preferred embodiment of the arrow holder according to the present invention.

FIG. 2 discloses an arrow holder 20, according to the present invention. Arrow holder 20 is shown as an essentially triangular wafer or plate-like member 22, having three sides 24 and three corners A, B and C. Each corner has an open and essentially circular notch 30 formed therein to frictionally engage the shaft 16 of an arrow 15.

Figure 3:
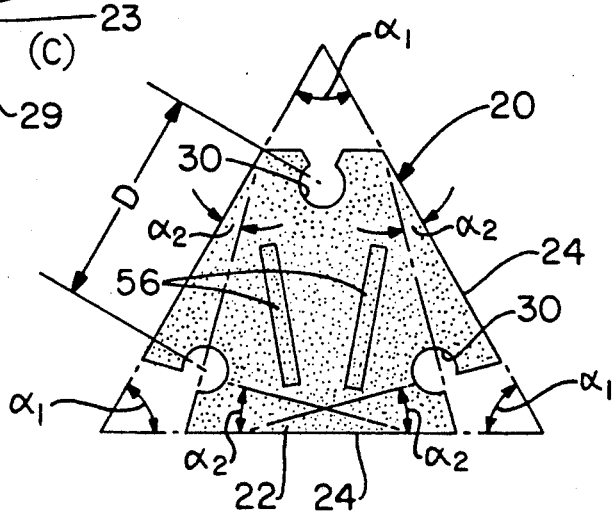
FIG. 3 is a top elevational view of one embodiment of the arrow holder illustrating the formation of notches at the corners of the device, according to the present invention.
Figure 7:
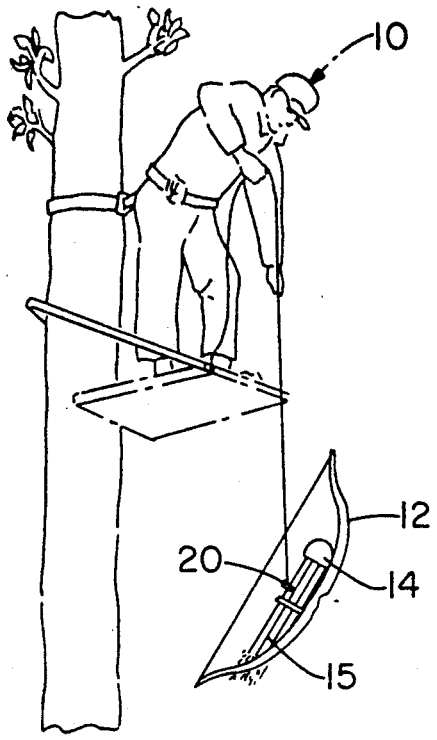
FIG. 7 is a perspective view illustrating the use of the alternative embodiment of the present invention disclosed in FIG. 6.
Figure 6:
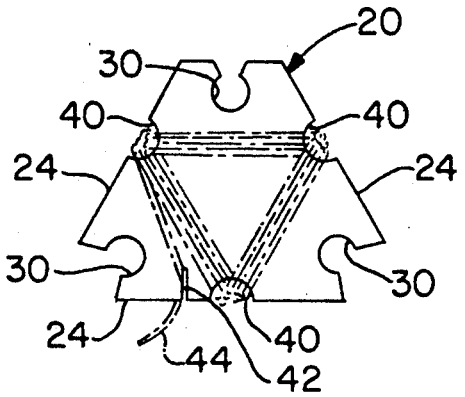
FIG. 6 is a top elevational view of an additional embodiment of the arrow holder according to the present invention.

Holder 20 is preferable made of a semi-rigid, yet resilient material, preferably of rubber, plastic or combinations thereof. One such currently preferred material is polyurethane. Arrow holder 20 can be formed by cutting from sheet stock, molding, or other known methods. Arrow holder 20 must have sufficient rigidity to support the weight of attached arrows 15 yet have sufficient flexibility to allow expansion around notches 30 and memory to allow the area around the notches 30 to reconverge around shaft 16 of arrow 15 once inserted therein. Arrow holder 20 is typically of uniform thickness, preferably but not exclusively from about ⅛" to about ⅜". However, holders 20 of increasing or varied thickness are contemplated. Additionally, rigid stays 56 may be secured to the surface of plate member 22 or molded within the body of the same to lend additional support or rigidity to holder 20, as illustrated at FIG. 3.

Notches 30 are formed essentially at the corners of holder 20 and are generally circular in shape and connected to the outside via opening 23. Notches 30 are dimensioned to engage the shaft 16 of an arrow 15 with a snug friction fit. Fingers 29 surrounding each notch 30 define opening 23 as having sufficient width to allow passage of an arrow shaft 16 therethrough as fingers 29 are forced outward in opposite direction upon the application of force to shaft 16. and directed inward to notch 30. Thereafter, the resilience or memory of holder 20 returns fingers 29 to their position at rest, thereby reducing the width of opening 23 to firmly retain shaft 15 and prevent unwanted withdrawal of shaft 16 from notch 30. As removal of arrow 15 is desired, force applied to arrow 15 and directed outward from holder 20 causes the expansion of opening 23 to permit removal of arrow shaft 16.

The notches 30 of one preferred embodiment are generally sized to engage the shaft of a standard arrow 15 having a diameter of about 0.300 inches with other holders 20 sized to engaged arrows with diameters of about 0.250 inches, such as those made from graphite. However, notches 30 corresponding to virtually any arrow shaft 15 diameter are contemplated.

Although the preferred embodiments disclose notches 30 located at the corners of each holder 20, any number of notches in a variety of spaced positions around the periphery are contemplated. Preferably, a distance of about 1⅛" is allowed between the center point of any two adjacent notches 30 to avoid damage to an arrow's fletching 18.

Notches 30 are inset at a slight distance from each outer wall 24 to allow for sufficient strength and memory of finger members 29. The preferred embodiment of FIGS. 2 and 3 illustrates a channel 25 formed by two converging inner surfaces 26 as shown with respect to corners B and C. Inner walls 26 form such angles as shown in FIG. 3 and represented as alpha 2, aid in the inserting of arrow shaft 16 into notch 30. A slight variation is shown with respect to corner A, which is formed in an essentially truncated configuration so as to define outer walls 28 and inner walls 27.

Figure 5:
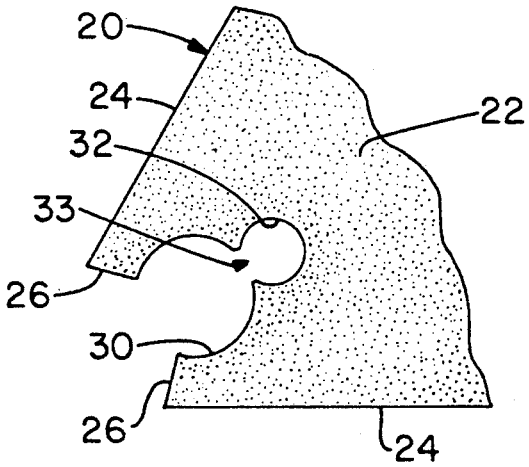
FIG. 5 is an enlarged elevational view illustrating an alternative embodiment of the notched portion of the arrow holder according to the present invention.
Figure 4:
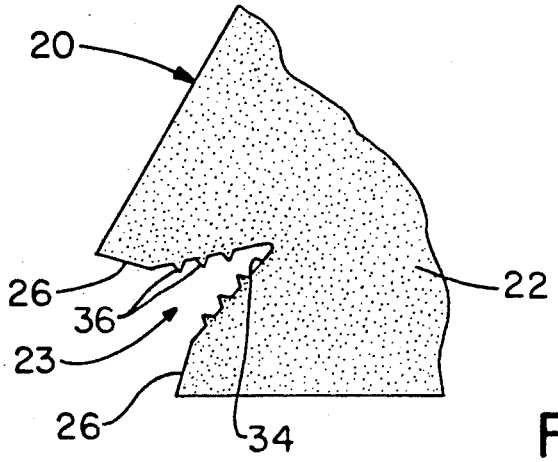
FIG. 4 is an enlarged elevational view of an alternative embodiment of the notched portion of an arrow holder according to the present invention.
Figure 9:
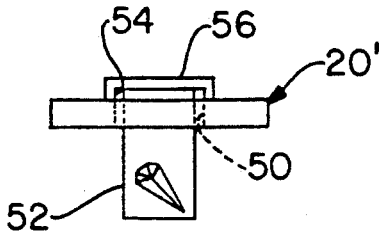
FIG. 9 is a cross-sectional view of the arrow holder disclosed in FIG. 8.

Alternative notch configuration desirable in certain embodiments are disclosed in FIGS. 4 and 5. FIG. 4 discloses a tapered notch 34 generally having a greater length than corresponding width and the length being greater than the diameter of a corresponding arrow shaft 16. Tapered notch 34 has its widest diameter adjacent to opening 23 with the diameter gradually decreasing toward its closed end. Tapered notch 34 enables arrow holder 20 to accommodate arrow shafts of varied diameter. In this manner, an arrow shaft 16 is inserted into tapered notch 34 with sufficient force until the proper frictional fit is obtained. Arrows having a relatively large shaft diameter are retained in a position in proximity of opening 23 and arrows having a reduced shaft diameter, such as those made of graphite, are retained in a position near the closed end of notch 34, distal to opening 23. FIG. 4 also discloses a plurality of corrugations or teeth 38 formed on the inner surface of notch 34 to further increase the gripping capability of notch 34. FIG. 5 discloses another alternative in the formation of a notch in arrow holder 20. A second notch 32 is formed inward of and adjacent to notch 30. Notch 30 and second notch 32 are interconnected by means of opening 33. Second notch 32 is shown as essentially circular and dimensioned slightly smaller than notch 30 to accommodate arrow shaft 16 having a smaller diameter than those engaged by notch 30. An arrow shaft 16 of reduced diameter is inserted into notch 30 and urged, by applied force, through opening 33 into frictional retention within notch 32.

An arrow holder 20 as shown in FIG. 2 is preferably paired with an identical holder to attach and secure a plurality of arrows to one another for ease of transport. A first arrow holder 20 engages each arrow shaft 16 in a region falling between the arrow tip 17 and the mid point of the arrow, while a second holder 20 engages each arrow shaft 16 in a region falling between the arrow's midpoint and the fletching 18. Accordingly, the arrows 15 are maintained in a parallel relationship to one another. For safety, the arrow tips 17 may be sheathed with individual or collective arrow covers.

Alternatively, arrow holder 20 is contemplated as an attachment to archer's 10 existing quiver in order to increase its arrow capacity. Arrows 15 are engaged by a pair of arrow holders 20 as previously explained herein at two corners such as B and C of holder 20 in FIG. 2. Corner A of each holder is then in turn secured to shaft 16 of an arrow 15 contained within the archer's quiver 14. In this way, the pair of arrow holders 20 serves to secure and suspend additional arrows from the quiver until used by archer 10. Following use of the arrows 15 suspended by holders 20, the holders 20 are then removed from the quivered arrow. Such arrow holders 20 being small and lightweight, can be easily stored until later use is desired.

Arrow holders 20 are also contemplated for use within quiver 14 to hold the arrows more firmly in place, thereby reducing the noise resulting from the movement of arrows within the quiver.

Figure 8:
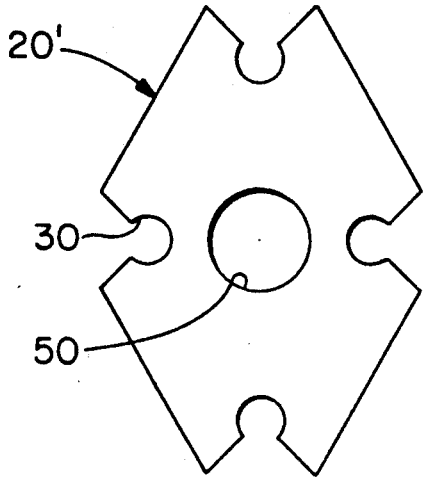
FIG. 8 is a top elevational view of yet another embodiment of an arrow holder according to the present invention.
Figure 11:
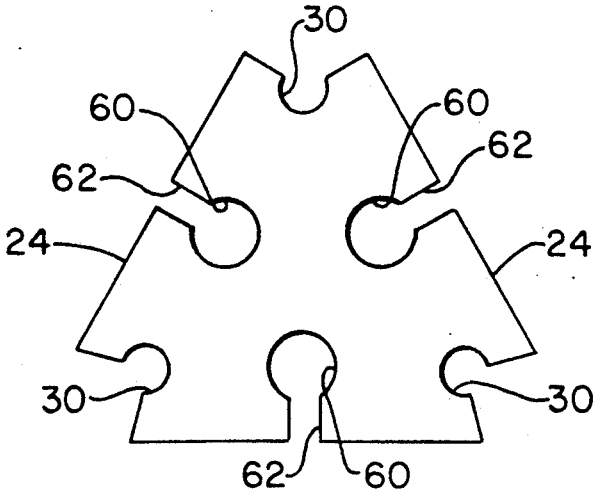
FIG. 11 is a top elevational view of still another embodiment of an arrow holder according to the present invention.

Arrow holders 20 are disclosed in FIGS. 2, 3, 4, 6 and 7 as being an essentially equilateral triangle having an open notch 30 cut at essentially each vertex. However, arrow holders 20 are contemplated as capable of taking on any regular or irregular geometric shape and having a plurality of open notches 30 cut at spaced intervals around its periphery. Several alternative shapes of arrow holders are illustrated in FIGS. 8 and 11. Additionally, arrow holders of circular, pentagonal, or hexagonal shapes, among others, are also contemplated.

Figure 10:
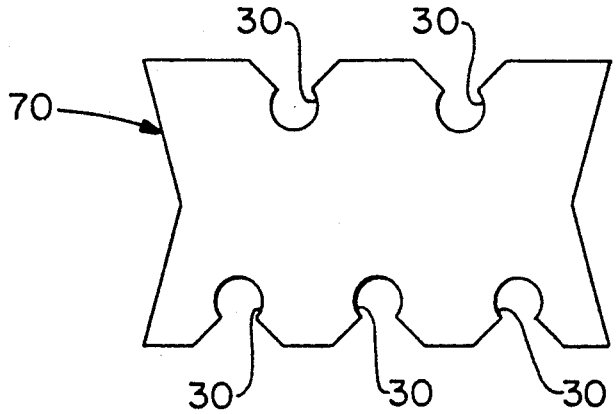
FIG. 10 is a top elevational view of yet another embodiment of an arrow holder according to the present invention.

While the most preferred embodiments disclose a triangular holder 20 having three notches 30, holders of any size as well as shape are contemplated. As illustrated at FIG. 10, arrow holders of sufficient size may contain additional notches offset and inward from notches 30 to accommodate additional arrow shafts. Notch 60 is an essentially circular notch of similar size to notches 30. Channel 62 has a greater length than channel 25 and serves to connect notch 60 with an outer wall or side 24. In this embodiment, sufficient distance between the center point of adjacent notches is still advisable to avoid damage to the arrow fletching 18. This embodiment is commonly used for the transporting of arrows independent of the bow or quiver. However, if such embodiments are used to secure or attach additional arrows to quivered arrows, the number of arrows which can be carried is limited by the strength of the engagement between the arrow holder 20 and the quivered arrow.

When additional engagement strength or stability between the arrow holder and the quivered arrows is required, the holder 20 retaining additional arrows may be secured to more than one quivered arrow as shown by holder 70 in FIG. 11.

Still another preferred embodiment is disclosed at FIGS. 4 and 5 wherein an arrow holder 20 has a plurality of grooves 40 formed in the outer walls 24. A length of monofilament line 44 or its equivalent is wound around holder 20 engaging grooves 40 so as not to obstruct notches 30. Once the desired length is wound onto holder 20 the terminal end of line 44 is prevented from unwinding by its insertion into slot 42 or by any other means commonly known in the art.

The line 44 is unwound from holder 20 as desired and thereafter, secured to a portion of the bow 12 or quiver 14. Archer 10, holding onto or otherwise securing the terminal end of line 44, is now able to climb into a tree stand or like without his/her bow. Once archer 20 is in a stabilized position he/she may use the line to pull the bow and its attachments up into position. Line 44 is then rewound onto arrow holder 20 for subsequent use.

Arrow holder 20' is shown at FIG. 8 as being an essentially diamond shape and having an aperture at its approximate center. Aperture 50 is dimensioned slightly larger than a corresponding container 52. Container 52 is prevented from complete passage through aperture 50 by container lip 54. Additionally, container 52 may be adhesively secured within aperture 50. Container 54 is intended to receive spare arrow parts such as tips and/or fletchings. Such parts are retained in container 52 by lid 56.

Figure 12:
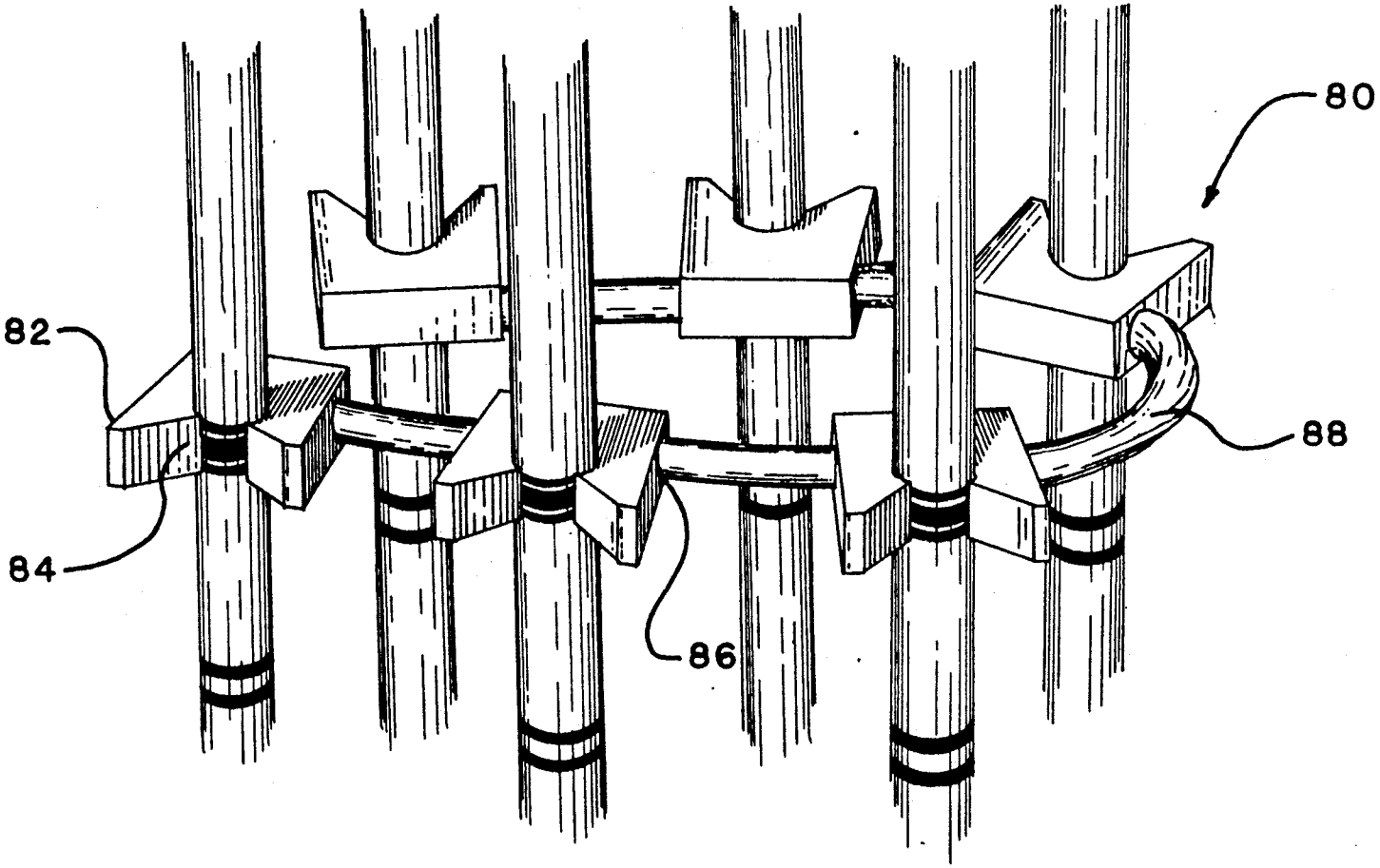
FIG. 12 is a perspective view of still another embodiment of an arrow holder according to the present invention.

Device 80 of FIG. 12 is yet another embodiment of the present invention and is formed by a plurality of resilient members 82 connected by a length of line or cord 88. Resilient members 82 slidably engage line 86 through aperture 86. Aperture 86 is dimensioned just slightly larger than the diameter of said cord 86 so as to slide along said cord 88 with significant resistance. Upon its placement at the desired position along line 88 said resilient member 82 remains in said position until further movement is desired and resists moderate forces urging said member along the line 88 in either direction. Line 88 is contemplated as a monofilament cord but could be made virtually of any line, cord or cable known in the art.

Said retaining members 82 are further disclosed as having at least one notch 84 formed in its periphery to receive an arrow shaft and retain the same in notch 84 with a friction fit.

Resilient members 82 can be added or subtracted from line 88, as is desired to correspond with the number of arrows to be secured. Furthermore, line 88 may be cut to any desired length.

Device 80 is contemplated as being utilized to tighten the formation of arrows in the quiver. In this manner the rattling of arrows against adjacent arrows or the quiver would be reduced or eliminated. It is contemplated that device 80 be adjustable to fit any quiver and additionally help to prevent arrows from slipping within the quiver.

While in accordance with the patent statutes, the best mode and preferred embodiment of the invention have been described, it is to be understood that the invention is not limited thereto, but rather is to be measured by the scope and spirit of the appended claims.

What is claimed is:

1. An archery device for securing one or more archery arrows to one or more archery arrows in a quiver comprising:

at least one essentially flat, resilient retaining member having sufficient thickness to contribute support to said member and a periphery defining at least one outer wall, said member generally being devoid of a functional internal aperture therethrough and having a plurality of notches formed therein and opening to the periphery of said member, each notch having an opening sufficient to allow passage of an arrow shaft therethrough and dimensioned to resiliently receive said arrow shaft with a friction fit;

said device capable of attachment exclusively between arrow shafts.

2. The archery device as recited in claim 1 wherein each notch comprises a plurality of corrugations about a substantial portion of an inner surface of said notch.

3. The archery device as recited in claim 1 wherein said notch is elongated and possesses a decreasing diameter along its length.

4. The archery device as recited in claim 1 wherein each opening of each said notch defines a pair of inner walls directed inward from said outer wall to said notch.

5. The archery device as recited in claim 1 wherein said member comprises a second plurality of notches formed inward from said periphery, each second notch connected to said outer wall by a second opening having a length greater than said first opening.

6. The archery device as recited in claim 1 wherein said member comprises a second plurality of notches inward of said first notches, each said first notch connected to a said second notch.

7. A archery device as recited in claim 1 wherein said member further comprises at least one rigid stay integral with said member to contribute support to said body.

8. A archery device as recited in claim 1 wherein said member further comprises a length of line, and a retaining means for retaining said line about said member.

9. A archery device as recited in claim 8 wherein said retaining means comprises a plurality of open grooves formed in the periphery of said member.

10. An archery device as recited in claim 1 wherein said member comprises a modified polygon shape having a plurality of end portions and at least one notch on each of at least two end portions.

11. An archery device as recited in claim 10 wherein said member comprises a modified triangular shape having three end portions and a notch at essentially each end portion.

12. An archery device as recited in claim 10 wherein said member comprises a modified diamond shape having four end portions and a notch at at least two end portions.

13. An archery device as recited in claim 10 wherein said member comprises a modified pentagonal shape having a plurality of end portions and a notch at at least two end portions.

14. An archery device as recited in claim 1 wherein at least two members engage each arrow shaft.

15. The archery device as recited in claim 14 wherein at least one engaged arrow is contained within a quiver.

16. The archery device as recited in claim 1 wherein such retaining body comprises a plastic material.

17. The archery device as recited in claim 16 wherein said plastic material comprises polyurethane.

18. The archery device as recited in claim 1 wherein said retaining body comprises a rubber base material.

19. A device for securing a plurality of archery arrows comprising:

a length of essentially flexible line;

a plurality of resilient retaining members, each retaining member having a periphery and slidably engaging said line through a bore with openings along said periphery, each said retaining member having at least one notch opening to the periphery of said member, each said notch having an opening sufficient to allow passage of an arrow shaft there through and dimensioned to resiliently receive said arrow shaft with a friction fit, said device capable of attachment exclusively between arrow shafts.

20. An archery device securing additional archery arrows to archery arrows in a quiver comprising:

an archery quiver for retaining a plurality of archery arrows;

at least one resilient retaining member having sufficient thickness to contribute support to said member and a periphery defining at least one outer wall, said member having a plurality of notches formed therein and opening to the periphery of said member, each notch having an opening sufficient to allow passage of an arrow shaft therethrough and dimensioned to resiliently receive said arrow shaft with a friction fit;

said at least one retaining member attaching one or more arrows external of said quiver to one or more arrow in said quiver.

* * * * *